US012338024B2

(12) United States Patent
Holmes et al.

(10) Patent No.: US 12,338,024 B2
(45) Date of Patent: Jun. 24, 2025

(54) SORTING SYSTEM FOR A MEDICATION PACKAGING SYSTEM

(71) Applicant: RXSAFE LLC, Vista, CA (US)

(72) Inventors: William K. Holmes, San Diego, CA (US); Tom F. Gaasch, Encinitas, CA (US); Aaron Arsenault, San Diego, CA (US)

(73) Assignee: RXSAFE LLC, Vista, CA (US)

( * ) Notice: Subject to any disclaimer, the term of this patent is extended or adjusted under 35 U.S.C. 154(b) by 60 days.

(21) Appl. No.: 18/313,197

(22) Filed: May 5, 2023

(65) Prior Publication Data

US 2024/0367843 A1 Nov. 7, 2024

(51) Int. Cl.

| | |
|---|---|
| ***B65B 57/10*** | (2006.01) |
| ***B65B 61/06*** | (2006.01) |
| ***B65B 61/26*** | (2006.01) |
| ***B65B 61/28*** | (2006.01) |

(52) U.S. Cl.

CPC ..... *B65B 61/06* (2013.01); *B65B 57/10* (2013.01); *B65B 61/26* (2013.01); *B65B 61/28* (2013.01)

(58) Field of Classification Search

None

See application file for complete search history.

(56) References Cited

U.S. PATENT DOCUMENTS

2014/0123601 A1* 5/2014 Murokh ..... B23K 26/355 53/411

2018/0091745 A1* 3/2018 Holmes ..... H04N 23/11

* cited by examiner

*Primary Examiner* — Chinyere J Rushing-Tucker

(74) *Attorney, Agent, or Firm* — Michael Best & Friedrich LLP

(57) ABSTRACT

An automatic packaging system including an automatic packager and a sorting device interoperably coupled to the automatic packager. The sorting device is configured to receive a strip of pouches and includes a holder assembly configured to hold the strip of pouches received from the automatic packager. The sorting device also includes a cutter assembly provided downstream of the holder assembly to receive the strip of packages from the holder assembly. The cutter assembly includes a blade and is configured to cut and separate an individual pouch from the strip of pouches using reciprocal motion of the blade. The sorting device receives the individual pouch from the cutter assembly and dispenses the individual pouch into a first bin or a second bin based on the verification status of the individual pouch.

7 Claims, 11 Drawing Sheets

SORTING SYSTEM FOR A MEDICATION PACKAGING SYSTEM

FIELD

The present disclosure relates to packaging systems for medications and, more particularly, to sorting systems for packaging medications.

SUMMARY

The techniques of this disclosure generally relate to a packaging system including an automatic packager and a sorting device.

In one embodiment, the present disclosure provides an automatic packager system including an automatic packager and a sorting device interoperably coupled to the automatic packager. The automatic packager includes a packager housing and a dispenser on the packager housing configured to dispense medications into a strip of pouches. The sorting device is configured to receive the strip of pouches and includes a holder assembly configured to hold the strip of pouches received from the automatic packager. The sorting device also includes a cutter assembly provided downstream of the holder assembly to receive the strip of packages from the holder assembly. The cutter assembly includes a blade and is configured to cut and separate an individual pouch from the strip of pouches using reciprocal motion of the blade. The sorting device further includes a diverter provided downstream of the cutter assembly to receive the individual pouch from the cutter assembly and configured to dispense the individual pouch into a first bin or a second bin based on the verification status of the individual pouch.

In another embodiment, the disclosure provides a sorting device including a holder assembly configured to hold a strip of pouches. A cutter assembly is provided downstream of the holder assembly to receive the strip of pouches from the holder assembly. The cutter assembly includes a blade and is configured to cut and separate an individual pouch from the strip of pouches using reciprocal motion. A diverter is provided downstream of the cutter assembly to receive the individual pouch from the cutter assembly. The diverter is configured to dispense the individual pouch into a first bin or a second bin based on a verification status of the individual pouch. An electronic processor is communicatively coupled to the holder assembly, the cutter assembly, and the diverter. The electronic processor is configured to control the cutter assembly to cut and separate an individual pouch from the strip of pouches and determine a verification status of the individual pouch. The electronic processor is further configured to control the diverter to direct the individual pouch into the first bin when the verification status indicates that the individual pouch is correctly filled and to control the diverter to direct the individual pouch into the second bin when the verification status indicates that the individual pouch is incorrectly filled.

In another embodiment, the disclosure provides a method of sorting medications using a sorting device. The method includes receiving, using a holder assembly of the sorting device, a strip of pouches and cutting, using a cutter assembly provided downstream of the holder assembly, an individual pouch from the strip of pouches. The method also includes receiving, at an electronic processor of the sorting device, an indication of a verification status of the individual pouch. The method further includes directing, using a diverter provided downstream of the cutter assembly, the individual pouch into a first bin when the verification status indicates that the individual pouch is correctly filled, and directing, using the diverter, the individual pouch into a second bin when the verification status indicated that the individual pouch is incorrectly filled.

Other aspects of the disclosure will become apparent by consideration of the detailed description and accompanying drawings.

BRIEF DESCRIPTION OF DRAWINGS

The accompanying figures, where like reference numerals refer to identical or functionally similar elements throughout the separate views, which together with the detailed description below are incorporated in and form part of the specification and serve to further illustrate various embodiments, examples, aspects, and features that include the claimed subject matter, and to explain various principles and advantages of aspects of those embodiments, examples, aspects, and features.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1:
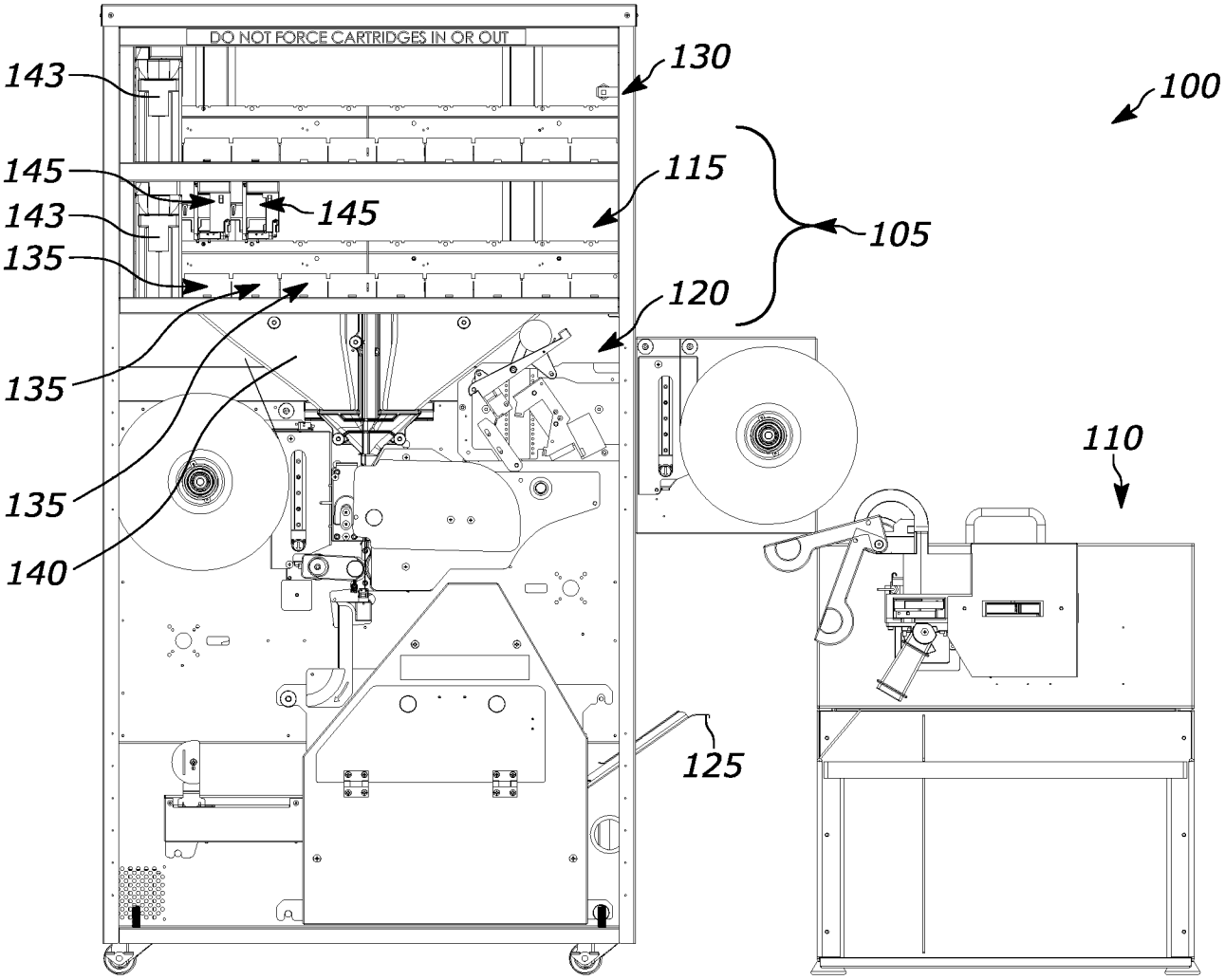
FIG. 1 is a front view of an automatic packager system in accordance with some embodiments.

FIG. 1 illustrates one example embodiment of an automatic packager system 100. In the example illustrated, the automatic packager system 100 includes an automatic packager 105 and a sorting device 110. The automatic packager 105 includes a universal feed cassette 115 and a packaging unit 120. The sorting device 110 is interoperably coupled to the packaging unit 120 and is configured to receive a strip of pouches 125 from the packaging unit 120. In some examples, the sorting device 110 can be separated from the automatic packager 105 such that the automatic packager 105 and the sorting device 110 may be used individually. The automatic packager system 100 can be used in pharmacies, healthcare facilities, online and mail order supplement and pharmaceutical distributors, and the like. FIG. 1 illustrates only one exemplary embodiment of the automatic packager system 100. In other embodiments, the automatic packager system 100 may include more or fewer components and may perform functions that are not explicitly described herein.

The universal feed cassette 115 receives medications (for example, pharmaceuticals, nutraceuticals, or supplements) from bulk canisters and individually dispenses the medications or supplements to the packaging unit 120. The medications can be in any form, for example, a pill, a capsule, a gummy, and the like. Each universal feed cassette 115 may dispense between 1 and 40 or more separate medications at the same time. The universal feed cassette 115 includes a housing 130 having a plurality of cartridge slots 135 within the housing 130. Dispensing openings are provided on the bottom of the housing 130 in communication with a manifold 140 of the packaging unit 120. In the example illustrated in FIG. 1, the universal feed cassette 115 includes up to twenty cartridge slots 135. The cartridge slots 135 are arranged in a two-level formation such that a second row of cartridge slots 135 are provided above a first row of cartridge slots 135 within the housing 130. The universal feed cassette 115, or the motor base, may also include one or more cameras or other sensors to verify whether the medications were dispensed into the packaging unit 120.

The cartridge slots 135 receive cartridges 143 and includes a plurality of cartridge mechanisms 145, one for each cartridge slot 135. When received in the cartridge slots 135, the cartridges 143 are connected to the cartridge mechanism 145. The cartridge mechanism 145 individually dispenses medications from the cartridge 143. The dispensing openings transfer the supplements from the cartridges 143 to the packaging unit 120 for packaging. In some embodiments, the automatic packager 105 may include a motor base in place of the universal feed cassette 115. The motor base includes a plurality of cartridge slots to receive medication cartridges. The motor base operates the medication cartridges to individually dispense medications.

Figure 2:
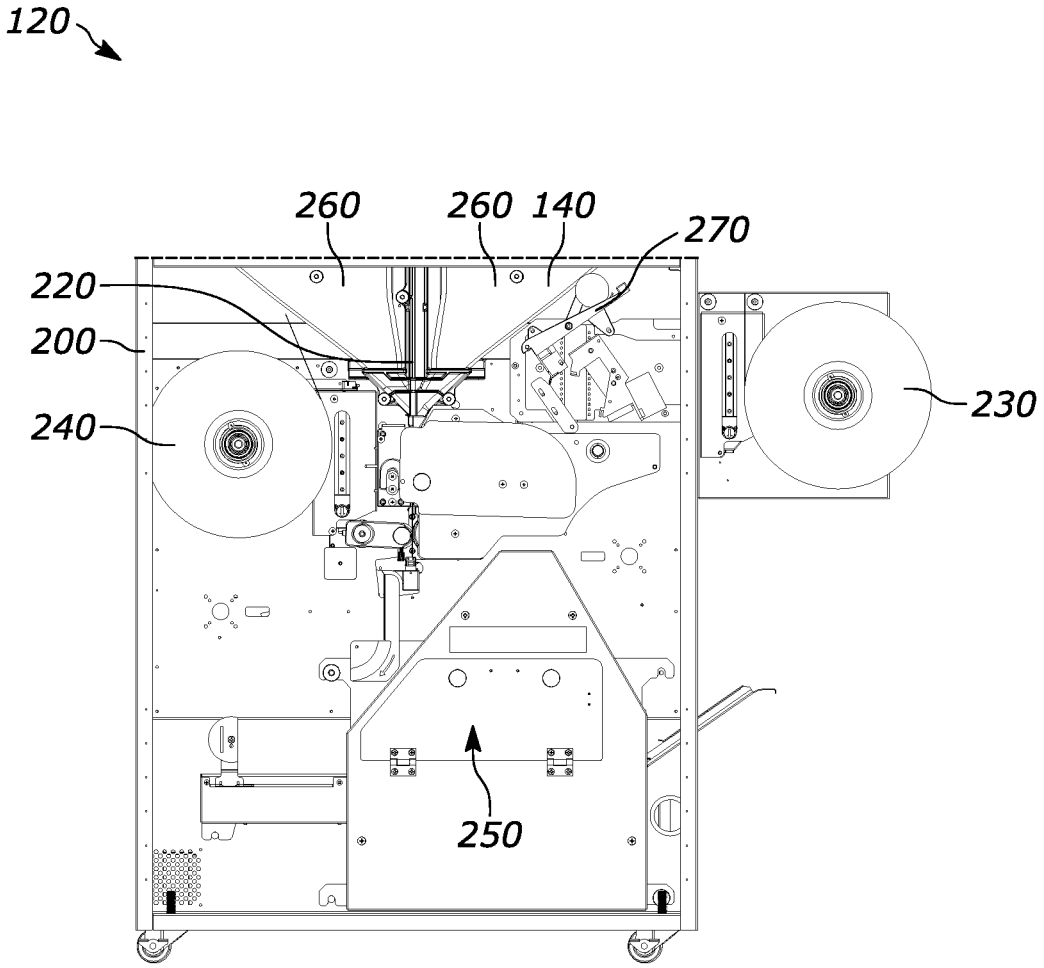
FIG. 2 is a front view of a packaging unit of an automatic packager of the automatic packager system of FIG. 1 in accordance with some embodiments.

FIG. 2 illustrates one example embodiment of the packaging unit 120. In the example illustrated, the packaging unit 120 includes a packager housing 200, a manifold 140, a receptacle 220, two feed stock rolls 230, 240, and a verification system 250. The universal feed cassette 115 is placed on top of the manifold 140. The manifold 140, or chute, may include a plurality of discrete tracks 260 to direct medications from the universal feed cassette 115 toward the receptacle 220. The universal feed cassette 115 is positioned generally above the receptacle 220 such that medications slide down the manifold 140 toward the receptacle 220. The tracks 260 isolate the medications from each other as the medications slide down the manifold 140 to the receptacle 220.

The receptacle 220 collects the medications from the manifold 140. After the medications pass through the receptacle 220, the medications are sandwiched between two strips of material (e.g., aluminum, plastic, paper, etc.) from the feed stock rolls 230, 240. The first feed stock roll 230 may be made of a first material that is opaque (e.g., a colored paper with printed branding or the like). The first feed stock roll 230 is positioned inside the packager housing 200. The second feed stock roll 240 may be made of a second material that is clear or translucent (e.g., a transparent material). In some embodiments, the first feed stock roll 230 and the second feed stock roll 240 may be made of the same material. The second feed stock roll 240 is positioned at an exterior of the packager housing 200. In some embodiments, the first feed stock roll 230 may be positioned outside the packager housing 200 and the second feed stock roll 240 may be positioned inside the packager housing 200. The two strips of material are then heat sealed together to form the strip of pouches 125 for the medications. In some embodiments, the packaging unit 120 may include a single feed stock roll having a single strip of material that is folded and/or heat sealed to form individual pouches.

In some embodiments, the packaging unit 120 may include a printer 270 to print a barcode, the patient's name, the date, the amount and type of medications contained within, and/or other indicia on the individual pouches 300 (shown in FIG. 3) as the individual pouches 300 are formed. The printer 270 in this embodiment is an ink jet printer, however, in other embodiments the printer 270 may be, for example, a thermal printer or an ink ribbon printer. An ink jet printer sprays liquid ink onto a paper and the liquid ink dries to form printed matter on the paper. For this reason, ink jet printers are usually placed at a downward angle to ensure that the ink does not fall back onto the printer due to gravity. In the illustrated embodiment, the printer 270 is placed at a downward angle to print on the strip of material from, for example, the first feed stock roll 230. The strip of material from the first feed stock roll 230 includes a first side that forms the inside of the individual pouch 300 and a second side that forms the outside of the individual pouch 300. The printer 270 is used to print indicia on the second side of the strip of material from the first feed stock roll 230. The strip of material is routed through the packaging 120 such that the second side of the strip of material is below the printer 270 for printing the indicia.

In some embodiments, the first strip of material is made of a plastic material. The ink from ink jet printers may take longer to dry on plastic material than on paper material. Water or alcohol is typically used as the solvent in inks for ink jet printer. To accommodate printing and fast drying on plastic material, inks having solvents with higher volatility are used in the printer 270. Specifically, solvents having a higher volatility than water and/or alcohol (e.g., ethanol) are used. In one example, the solvent used in the ink for the printer 270 is acetone. Ink with higher volatility solvents allow the printer 270 to print on plastic material, yet still print in color.

Figure 3:
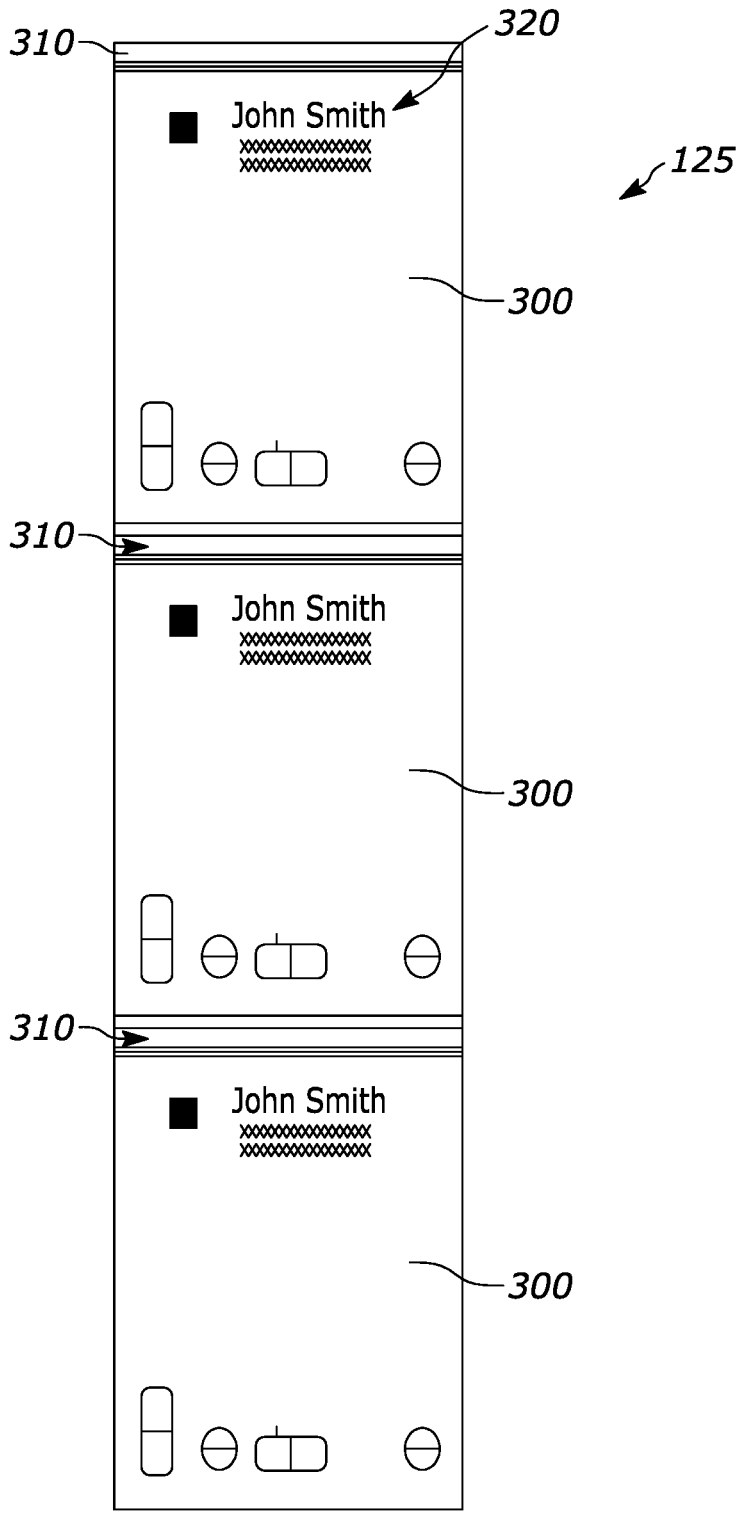
FIG. 3 illustrates a strip of pouches packaged using the automatic packager of FIG. 2 in accordance with some embodiments.

FIG. 3 illustrates the strip of pouches 125 containing different medications therein. The illustrated strip of pouches 125 is an example of the strip of pouches 125 that may be formed using the packaging unit 120 of the automatic packager system 100 described above. The strip of pouches 125 is a collection of individual pouches 300 separated by a heat seal 310. As discussed above, identification indicia 320 (e.g., a patient's name, a barcode, type of medication, etc.) is printed on each individual pouch 300 using the printer 270. In some embodiments the identification indicia 320 may include only a barcode 320 (or QR code). In some embodiments, the identification indicia 320 may be printed on a label with a thermal printer, a thermal transfer ribbon, or on a label that is coupled to the individual pouch 300 with adhesives.

Figure 4:
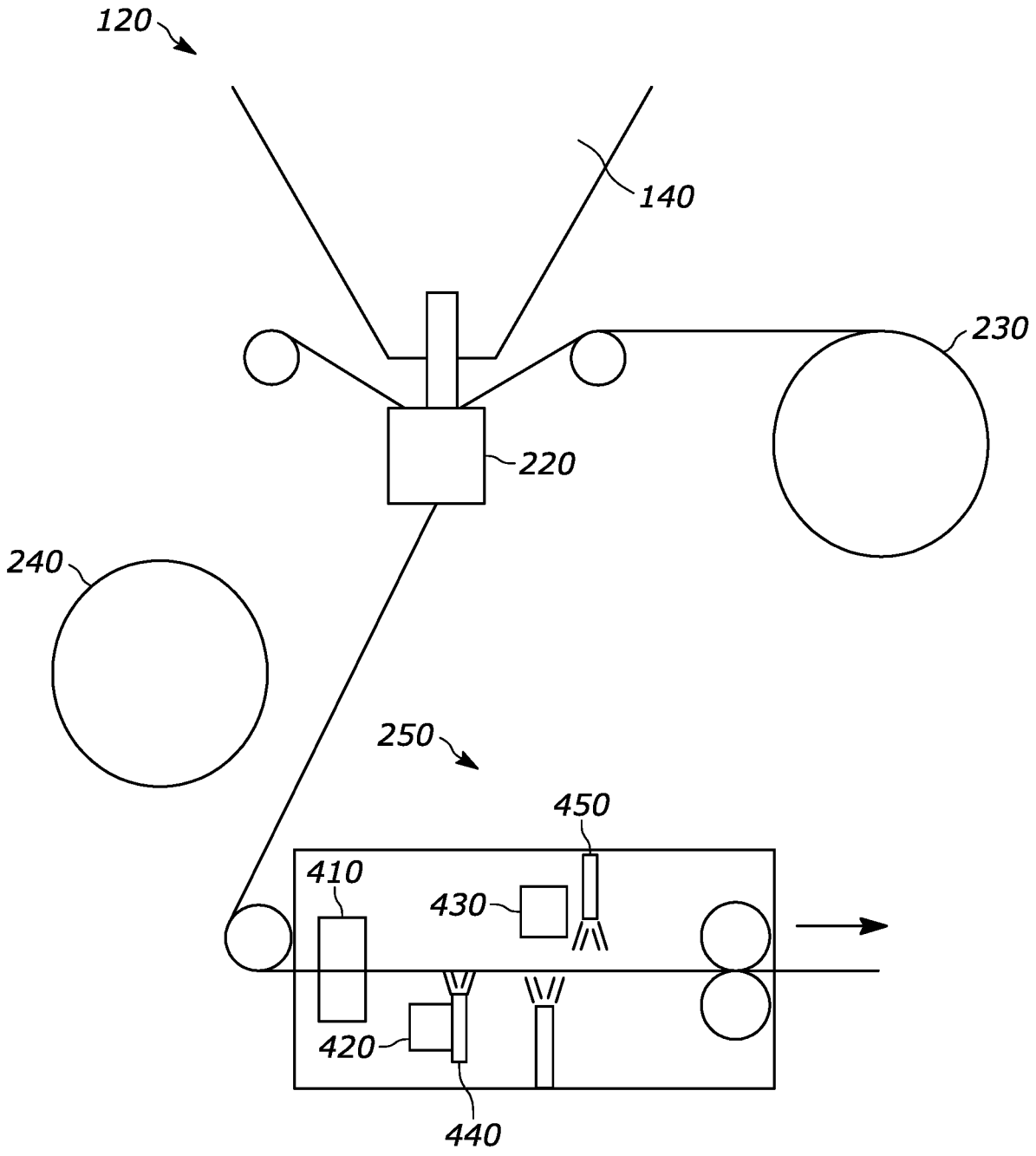
FIG. 4 is a schematic of a verification system of the automatic packager of FIG. 2 in accordance with some embodiments.

FIG. 4 schematically illustrates one example embodiment of the verification system 250. The verification system 250 is positioned downstream of the receptacle 220 and the pouch sealing mechanism. The verification system 250 includes components to compare the actual contents of the filled individual pouch 300 to the expected contents of the individual pouch 300. The verification system 250 provides a final check of the filled strip of pouches 125 before the strip of pouches 125 is fed to the sorting device 110. In the example illustrated, the verification system 250 includes an agitator 410, a sensor 420, and a camera system 430 including one or more cameras. In other embodiments, the verification system 250 may include fewer or more cameras. After the individual pouches 300 are filled and sealed, the strip of pouches 125 is directed by sheaves or pulleys into the verification system 250.

As the pouches 300 enter the verification system 250, the agitator 410 engages (e.g., agitates, vibrates, etc.) the pouches 300 to help the medications within each pouch 300 settle and separate or spread out. After the individual pouches 300 are agitated, the individual pouches 300 pass the sensor 420. In some embodiments, the sensor 420 is a barcode scanner. In other embodiments, the sensor 420 is a label camera that captures images of label (or barcode 320) of the pouch 300. The sensor 420 is positioned on a label side of the strip of pouches 125 and captures an image of the indicia 320 on each individual pouch 300. A first light source 440 is also positioned on the same side of the individual pouches 300 as the sensor 420 to selectively illuminate the individual pouches 300 while the sensor 420 captures an image of the indicia 320. The sensor 420 can communicate with the electronic processor 1220 and a memory 1230 of the control system 1210 (see FIG. 12) to store the image or data related to the read/scanned indicia 320. The electronic processor 1220 can also control the operation of the first light source 440 (e.g., when the light source 440 is turned on and off).

The strip of pouches 125 then passes through the camera system 430. In the example illustrated, the camera system 430 includes a single camera with an infrared filter removed to capture both infrared images (for example, an image in the infrared spectrum) and visible light images (for example, an image in the visible spectrum). A first light source 440 (or heat source) is positioned on a side of the pouches 300 opposite the camera system 430. The first light source 440 shines light through the pouches 300 toward the camera system 430 to illuminate the pouches 300. Light from the first light source 440 passes through the packaging material so that the medications within each pouch cast shadows against, for example, the opaque or translucent white paper of the packaging material. In some embodiments, the packaging material is made of metallic material (e.g., aluminum foil) or other suitable material. In these embodiments, the first light source 440 (or heat source) causes the packaging material to heat up quicker than the medications within the pouch 300 due the different heat properties. The medications form dark shadows against the packaging material in the image of the pouch 300 captured by the camera system 430.

As the strip of pouches 125 are positioned under the camera system 430, a second light source 445 also illuminates the strip of pouches 125. The second light source 445 is positioned on the same side of the strip of pouches 125 as the camera system 430 (e.g., on the side of the individual pouches 300 facing the transparent material) to shine light on the individual pouch 300 and illuminate contents of the individual pouch 300. When the second light source 445 illuminates the strip of pouches 125, the camera system 430 captures a visible light image of each pouch 300 showing the color shape, contour, surface finish, etc. of each medication. In the illustrated embodiment, the strip of pouches 125 are stopped under the camera system 430 to capture the IR image and the visible light image. The camera system 430 captures both images without moving so the images are lined-up for computer manipulation. In alternative embodiments, the camera system 430 may capture only IR images. Although shown on opposite sides, the sensor 420 and the camera system 430 may be placed on the same side depending on the location of the indicia 320 on the pouches 300. In some embodiments, the sensor 420 may not be needed or may be included as part of the camera system 430 and the indicia 320 can be captured by the camera system 430. The first light source 440 and the second light source 445 may be part of the camera system 430 and controlled by the electronic processor 1220 (shown in FIG. 12).

In some embodiments, the verification system 250 may provide real-time monitoring of the pouches as they pass through the system. For example, after the camera system 430 captures an infrared image of a pouch, the electronic processor 1220 analyzes the image to determine the number and approximate size of each medication within the individual pouch 300. Based on the indicia 320 printed on the individual pouch 300, the electronic processor 1220 determines the correct medications to be loaded into the individual pouch 300. The electronic processor 1220 analyzes the image of the individual pouch 300 produced by the camera system 430, determines the medications inside of the individual pouch 300, compares the medications in the individual pouch 300 to the list designated by the indicia 320, and verifies whether each pouch 300 is properly filled with the correct type of medications. The electronic processor 1220 then indicates a verification status of the individual pouch 300. Once the individual pouches 300 are verified, the strip of pouches 125 is directed to the sorting device 110.

When the verification system 250 determines that a pouch is incorrectly filled, the verification system 250 can communicate with the universal feed cassette 115 and the packaging unit 120 to fill another pouch 300 with the same prescription order, without having to wait for further input from the pharmacist or other technician. As such, disruptions to the packaging system are reduced.

Figure 5:
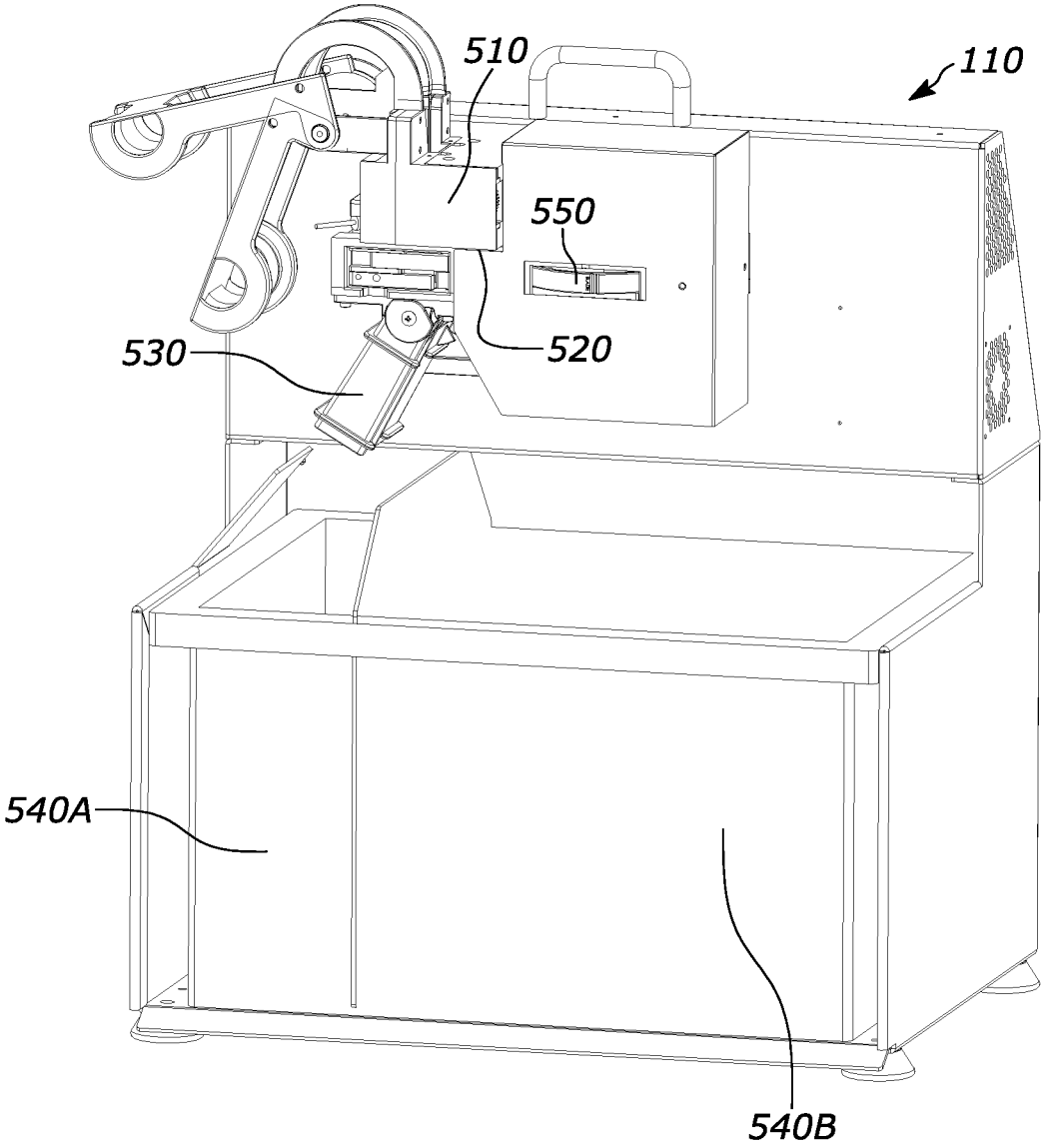
FIG. 5 is a perspective view of a sorting device of the automatic packager system of FIG. 1 in accordance with some embodiments.

FIG. 5 illustrates one example embodiment of the sorting device 110. In the example illustrated, the sorting device 110 includes a holder assembly 510, a cutter assembly 520, a diverter 530, and sorting bins 540. The sorting device 110 receives the strip of pouches 125 after the strip of pouches 125 is verified by the verification system 250. The sorting device 110 is interoperably coupled to the packaging unit 120 such that the strip of pouches 125 travels directly from the automatic packager 105 to the sorting device 110. In other words, a user or another machine does not need to transfer the strip of pouches 125 from the automatic packager 105 to the sorting device 110. In some embodiments, the sorting device 110 may be physically connected to or integrated into the automatic packager 105. In other embodiments, such as the embodiment shown in FIG. 1, the sorting device 110 may be separate from, but adjacent the automatic packager 105. After receiving the strip of pouches 125 from the packaging unit 120, the holder assembly 510 holds the strip of pouches 125 to keep the strip of pouches 125 stable.

A blade mechanism 550 of the cutter assembly 520 cuts along each heat-sealed edge of the strip of pouches 125 to separate the individual pouches 300. In some embodiments, the blade mechanism 550 may cut groups of pouches rather than individual pouches 300 (e.g., every other pouch, every third pouch, etc.). After the individual pouch 300 is separated from the strip of pouches 125, the diverter 530, or sorter, receives the individual pouch 300 and dispenses the individual pouch 300 into a first bin 540A or a second bin 540B, depending on the verification status as further described below. The diverter 530 directs the individual pouch 300 into the first bin 540A when the verification status indicates that the individual pouch 300 is filled correctly. The diverter 530 directs the individual pouch 300 into the second bin 540B when the verification status indicates that the individual pouch 300 is filled incorrectly. In some embodiments, the sorting device 110 may include fewer or more bins 540 than illustrated in FIG. 6.

Figure 6:
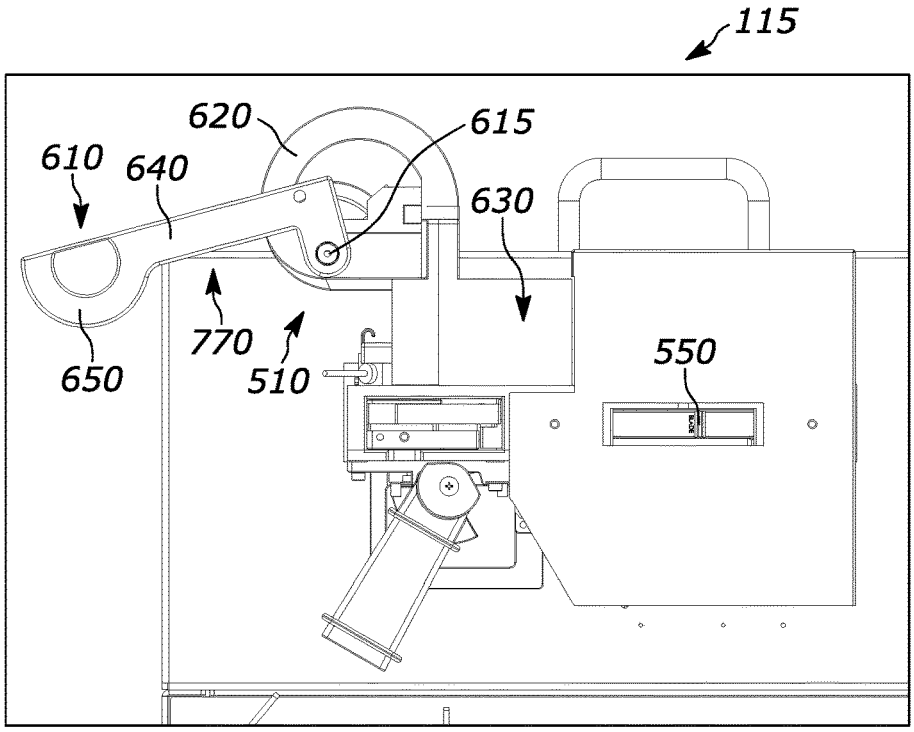
FIG. 6 is a front view of a holder assembly of the sorting device of FIG. 6 in a first position in accordance with some embodiments.
Figure 7:
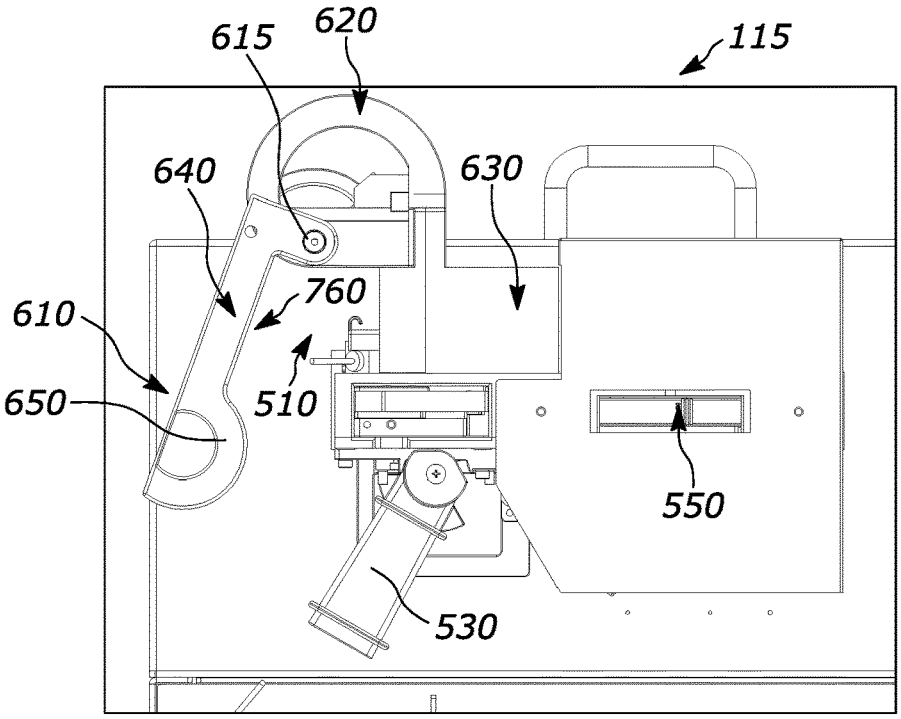
FIG. 7 is a front view of a holder assembly of the sorting device of FIG. 6 in a second position in accordance with some embodiments.

With reference to the example of FIGS. 6-7, the holder assembly 510 includes a pouch tensioner 610, a pouch guide 620, and a pouch feeder 630. The pouch tensioner 610 is pivotably connected to the pouch guide 620, for example, using a hinge connection 615 between the pouch tensioner 610 and the pouch guide 620. The pouch tensioner 610 includes an elongated holding portion 640 and a pouch receiving portion 650. One end of the elongated holding portion 640 is pivotably coupled to the pouch guide 620. The pouch receiving portion 650 has a semicircular shape and is provided at the other, opposite end of the elongated holding portion 640. The elongated holding portion 640 and the receiving portion 650 may be integrally formed. The pouch guide 620 has a circular or semi-circular shape and is fixed with respect to the housing of the sorting device 110. The pouch tensioner 610 is fixed to one end of the pouch guide 620, and the pouch feeder 630 is fixed to the other opposite end of the pouch guide 620

The strip of pouches 125 from the packaging unit 120 are received by the holder assembly 510. Specifically, the strip of pouches 125 are routed through pouch receiving portion 650 and the elongated holding portion 640 of the pouch tensioner 610. The strip of pouches 125 are then guided from the pouch tensioner 610 to the pouch feeder 630 using the pouch guide 620. The pouch guide 620 helps align the strip of pouches such that regardless of the angle at which the strip of pouches 125 are received at the pouch tensioner 610, the strip of pouches 125 are received vertically at the pouch feeder 630. The pouch feeder 630 directs the strip of pouches 125 to the cutter assembly 520.

The tension in the strip of pouches 125 between the packaging unit 120 and the sorting device 110 varies based on the relative speed of operation between the packaging unit 120 and the sorting device 110. The pouch tensioner 610 pivots between various positions (for example, a plurality of positions) depending on the tension in the strip of pouches 125. For example, when the strip of pouches 125 between the packaging unit 120 and the sorting device 110 are slack, the pouch tensioner 610 is in a first position 760 (shown in FIG. 7). When the strip of pouches 125 between the packaging unit 120 and the sorting device 110 is taut, the pouch tensioner 610 is a second position 770 (shown in FIG. 6). In the example illustrated, the first position 760 is lower than the second position 770. The pouch tensioner 610 may normally be biased (e.g., due to gravity) to the first position 760 and is moved to the second position 770 due to increasing tension of the strip of pouches 125.

A tension sensor 670 (shown in FIG. 12) is configured to sense tension in the strip of pouches 125 based on the position of the pouch tensioner 610. The tension sensor 670 may be a mechanical sensor (e.g., a tenson transducer), an optical sensor, a magnetic (e.g., Hall) sensor, or the like that detects the position of the pouch tensioner 610 to determine whether the strip of pouches 125 are slack or taut.

Figure 8:
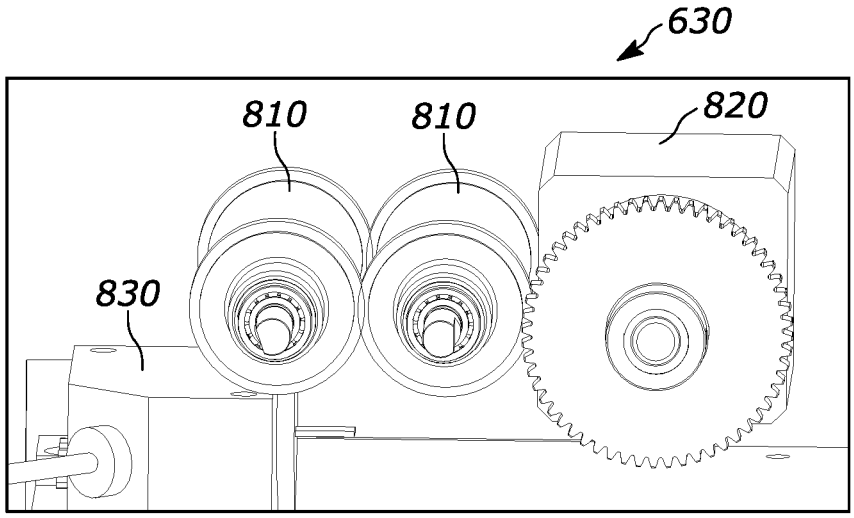
FIG. 8 is a front view of a holder of the sorting device of FIG. 6 with a housing portion removed in accordance with some embodiments.

Referring to FIG. 8, the pouch feeder 630 includes two pouch feed rollers 810 and a pouch feed actuator 820 (e.g., a motor, a solenoid, or the like) for rotating the pouch feed rollers 810. A gear system may be used to connect the pouch feed actuator 820 to the pouch feed rollers 810 to rotate the pouch feed rollers 810. The strip of pouches 125 is received between the two pouch feed rollers 810. When the pouch feed rollers 810 are rotated using the pouch feed actuator 820, the pouch feed rollers 810 pull the strip of pouches 125 to advance the strip of pouches 125. A pouch end sensor 830 is provided below the pouch feed rollers 810. The pouch end sensor 830 includes, for example, an optical sensor or other type of sensor to sense the end of the strip of pouches 125.

Figure 9:
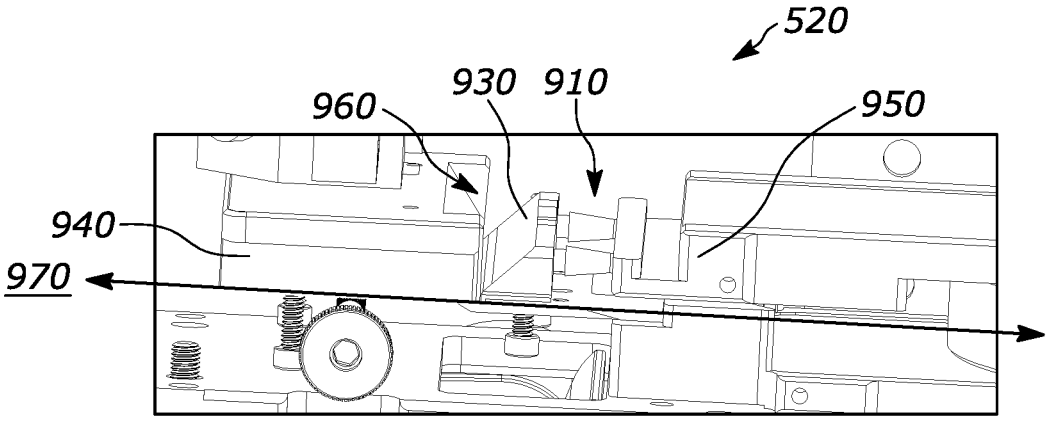
FIG. 9 is a front view of a clamp assembly of the sorting device of FIG. 6 in accordance with some embodiments.
Figure 10:
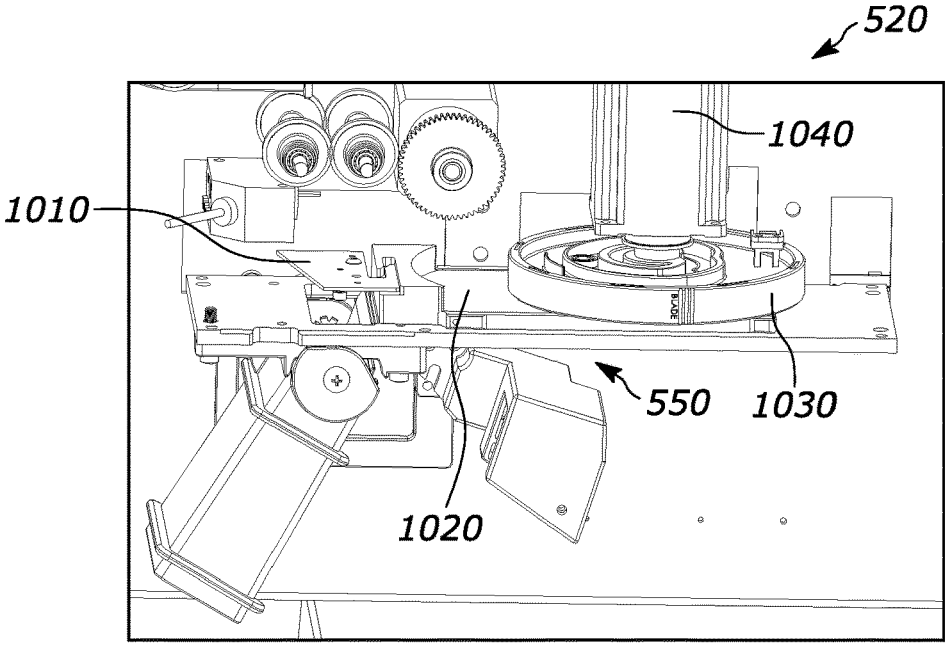
FIG. 10 is a front view of a cutting device of the sorting device of FIG. 6 in accordance with some embodiments.

With reference to FIGS. 9 and 10, the cutter assembly 520 includes a clamp assembly 910 and a blade mechanism 550. The pouch feed rollers 810 direct the strip of pouches 125 into the clamp assembly 910. The clamp assembly 910 includes a clamp actuator 920, a clamp 930, a clamp frame 940, a clamp slider 950, and a clamp slot guide 960. The clamp frame 940 supports the clamp 930. The clamp slider 950 slides the clamp 930 along a cutting axis 970 to engage and disengage the clamp 930 with the clamp frame 940. The clamp actuator 920 is used to drive the clamp slider 950. The clamp slot guide 960 guides the strip of pouches 125 into a clamp slot to then be held by the clamp 930. In some embodiments, the clamp 930 is made of a rubber material. In other embodiments, the clamp 930 can also be made of different materials (e.g., metal, plastic, etc.).

Referring to FIG. 10, the blade mechanism 550 includes a blade 1010, a blade slider 1020, a blade cam 1030, and a blade actuator 1040 (e.g., a motor, a solenoid, etc.). The blade 1010 is connected to the blade slider 1020 to move with the blade slider 1020. The blade cam 1030 is connected to a blade actuator 1040 and rotates with the blade actuator 1040. The blade cam 1030 is connected to the blade slider 1020 such that the rotation of the blade cam 1030 causes the reciprocal linear motion of the blade slider 1020.

Figure 11:
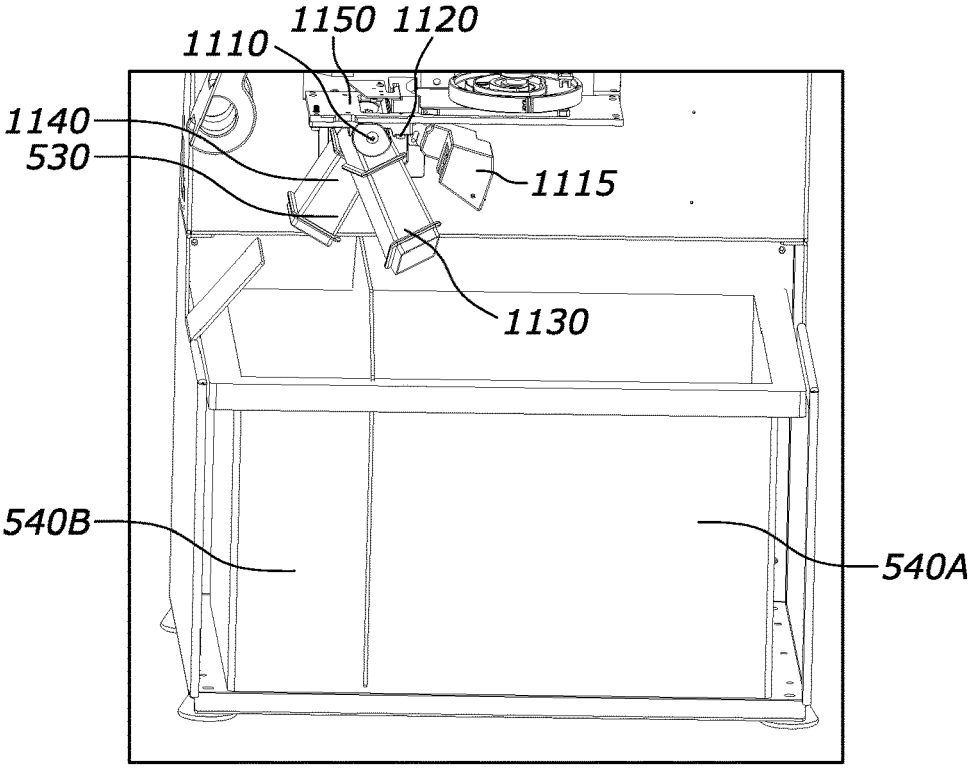
FIG. 11 is a front view of a diverter included in the sorting device of FIG. 6.

Referring to FIG. 11, the diverter 530 is provided downstream from the cutter assembly 520 (that is, the blade mechanism 550). In the example illustrated, the diverter 530 is pivotably connected to the cutter assembly 520 using a hinge 1110. A diverter actuator 1120 (e.g., a motor, a solenoid, or the like) controls the hinge 1110 to pivot the diverter 530 between a first diverter position 1130 and a second diverter position 1140. When in the first diverter position 1130, the diverter 530 directs the individual pouches 300 cut from the strip of pouches 125 into the first bin 540A. When in the second diverter position 1140, the diverter 530 directs the individual pouches 300 cut from the strip of pouches 125 into the second bin 540B.

In some embodiments, the sorting device 110 may include more than two bins 540A, 540B. For example, the sorting device 110 may include a plurality of bins 540. In these embodiments, the diverter 530 is movable (e.g., pivotable) between a plurality of diverter positions (for example, more than two). In one example, a diverter manifold may be used to connect the diverter 530 to the multiple bins 540 such that the individual pouches 300 can be directed to the multiple bins 540 from the diverter 530. In other embodiments, the diverter 530 may move about multiple degrees of freedom or move along a track to direct pouches 300 to different bins 540. Additionally, the sorting may be performed for reasons other than the verification status. For example, pouches 300 containing a first type of medication may be directed to a first bin 540A and pouches 300 containing a second type of medication may be to a second bin 540B based on determining the type of medication packaged in the pouches 300. In some embodiments, the cutter assembly 300 may separate more than one individual pouch 300 at a time from the strip of pouches 125. For example, the cutter assembly 300 may separate (or cut) two individual pouches 300 from the strip of pouches 125 such that two individual pouches 300 are joined to each other and directed accordingly using the diverter 530. For example, single pouches may be directed to a first bin, a group of two pouches may be directed to a second bin, a group of three pouches may be directed to a third bin, etc.

A pouch sensor 1115 (for example, a diverter camera) is provided below the cutter assembly 520 and is configured to identify the pouch 300 released from the cutter assembly 520. The pouch sensor 1115 is positioned on the side of the individual pouch 300 that has the indicia 320 (e.g., a barcode 320). In some embodiments, the pouch sensor 1115 is a barcode or a QR code scanner. In other embodiments, the pouch sensor 1115 is a camera configured to capture an image of the pouch or the indicia 320 on the pouch 300.

Figure 12:
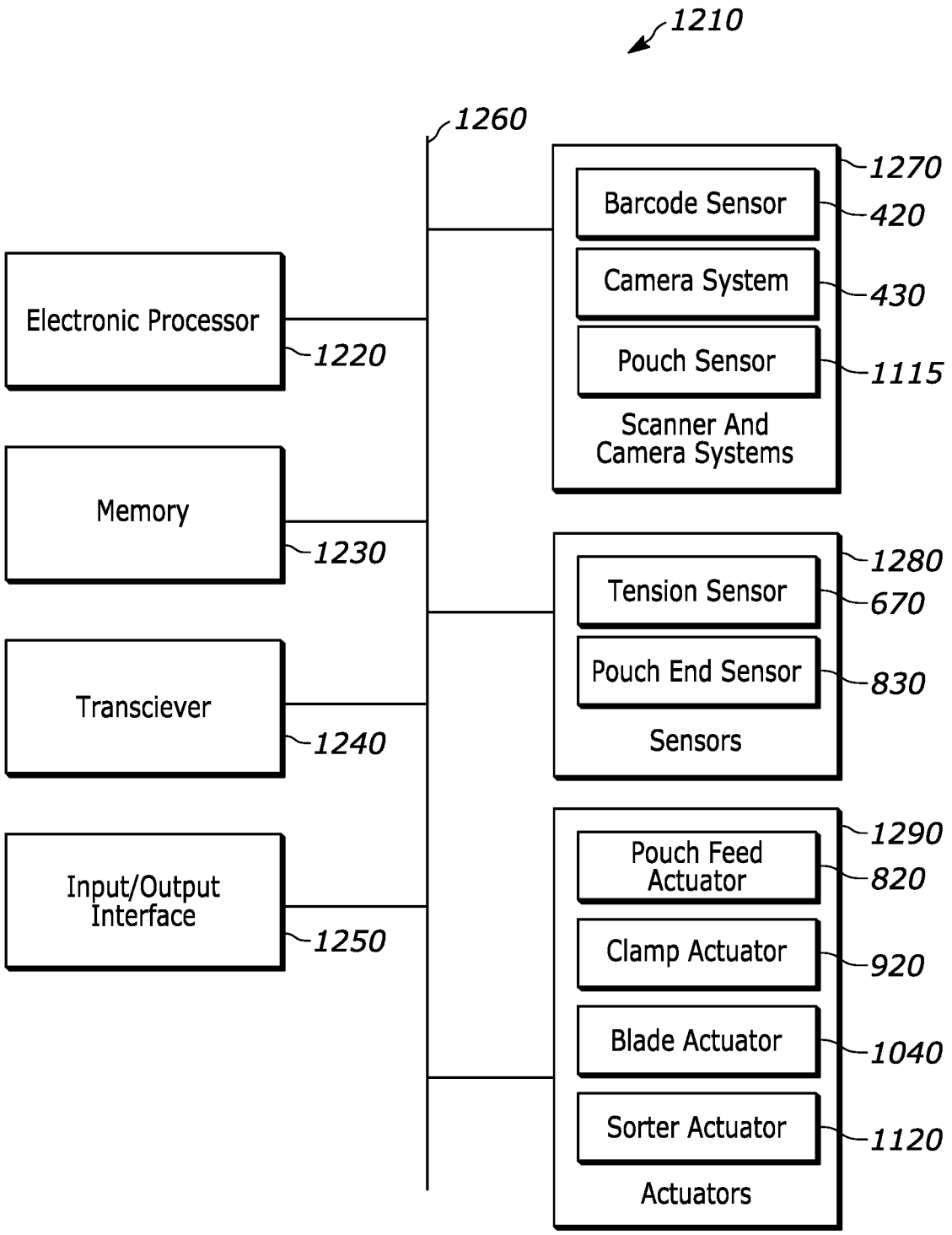
FIG. 12 is a control system of the automatic packager system of FIG. 1 in accordance with some embodiments.

FIG. 12 illustrates one example embodiment of a control system 1210 for the automatic packager system 100. In the illustrated example, the control system 1210 includes an electronic processor 1220, a memory 1230, a transceiver 1240, an input/output interface 1250, one or more scanner and/or camera systems 1270, one or more sensors 1280, and one or more actuators 1290. The electronic processor 1220, the memory 1230, the transceiver 1240, the input/output interface 1250, the one or more scanner and/or camera systems 1270, the one or more sensors 1280, and the one or more actuators 1290 communicate over one or more control and/or data buses (e.g., a communication bus 1260). FIG. 12 illustrates only one exemplary embodiment of the control system 1210. The control system 1210 may include more or fewer components and may perform functions other than those explicitly described herein.

In some embodiments, the electronic processor 1220 is implemented as a microprocessor with separate memory, such as the memory 1230. In other embodiments, the electronic processor 1220 may be implemented as a microcontroller (with memory 1230 on the same chip). In other embodiments, the electronic processor 1220 may be implemented using multiple processors. In addition, the electronic processor 1220 may be implemented partially or entirely as, for example, a field-programmable gate array (FPGA), an application specific integrated circuit (ASIC), and the like, and the memory 1230 may not be needed or be modified accordingly. In the example illustrated, the memory 1230 includes non-transitory, computer-readable memory that stores instructions that are received and executed by the electronic processor 1220 to carry out functionality of the control system 1210 described herein. The memory 1230 may include, for example, a program storage area and the data storage area may include combinations of different types of memory, such as read-only memory and random-access memory. In some embodiments, the automatic packager system 100 may include one electronic processor 1220, and/or a plurality of electronic processor 1220 distributed between various components of the automatic packager system 100, one or more of which may be executing none, all, or a portion of the applications of the automatic packager system 100 described herein, sequentially or in parallel across the one or more electronic processors 1220. The one or more electronic processors 1220 comprising the automatic packager system 100 may be geographically co-located or may be geographically separated and interconnected via electrical and/or optical interconnects. For example, the electronic processor 1220 may be distributed either fully or partially in one or more of the components (that is, the universal feed cassette 115, the packaging unit 120, the verification system 250, and the sorting device 110) of the automatic packager system 100. One or more proxy servers or load balancing servers may control which one or more electronic processors 1220 perform any part or all of the applications described herein.

The transceiver 1240 enables wired and/or wireless communication between the automatic packager system 100 and an external device or between the various components of the automatic packager system 100. In some embodiments, the transceiver 1240 may include separate transmitting and receiving components, for example, a transmitter and a receiver. The input/output interface 1250 (e.g., a user interface) may include one or more input mechanisms (e.g., a tough screen, a keypad, a button, a knob, and the like), one or more output mechanisms (e.g., a display, a printer, a speaker, and the like), or a combination thereof. The input/output interface 1250 receives input from the input devices actuated by a user and provides output to the output devices with which the user interacts. In some embodiments, as an alternative or in addition to managing inputs and outputs through the input/output interface 1250, the control system 1210 may receive user inputs, provide user outputs, or both by communicating with an external device, such as a console computer, over a wired or wireless connection.

It should be noted that although a single control system 1210 is shown in FIG. 12, the automatic packager system 100 may include more than one control system 1210 that are acting together to perform the applications described herein. In one example, a separate control system may be provided for each of the automatic packager 105, the sorting device 110, the universal feed cassette 115, the packaging unit 120, and so on. However, a single control system 1210 encompassing the various control systems is illustrated and described for simplicity. The various components of the single control system 1210 may be distributed across the various components of the automatic packager system 100 without deviating from the disclosure herein.

The one or more scanner and/or camera systems 1270 includes, for example, the barcode scanner 420, the camera system 430, and the pouch sensor 1115. The one or more scanner and camera systems 1270 may include additional scanner and/or camera systems, for example, scanners and/or camera systems of the universal feed cassette 115, the packaging unit 120, and the like. The one or more sensors 1280 includes, for example the tension sensor 670 and the pouch end sensor 830. The one or more sensors may include additional sensors, for example, sensors of the universal feed cassette 115, the packaging unit 120, and the like. The one or more actuators 1290 includes for example, the pouch feed actuator 820, the clamp actuator 920, the blade actuator 1040, the diverter actuator 1120. The one or more actuators 1290 may include additional actuators, for example actuators of the universal feed cassette 115 or the motor base, the packaging unit 120, the verification system 450, and/or the like.

Figure 13:
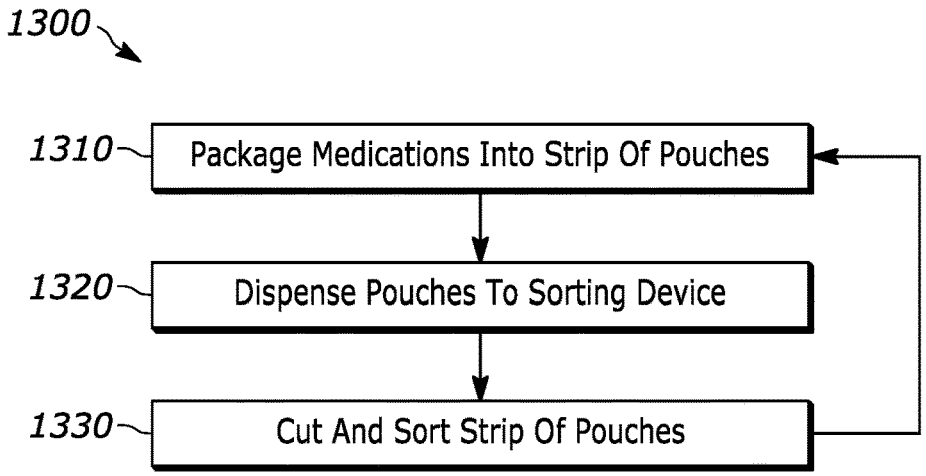
FIG. 13 is a flowchart depicting a method of packaging and sorting medications.

FIG. 13 is a flowchart illustrating one example method 1300 of operating the automatic packager system 100. The method 1300 leverages the automated nature of the automatic packager system 100 to package medications into pouches and sort the pouches into the bins based on whether the pouches are correctly packaged. The method 1300 includes packaging, using the automatic packager 105, medications into the strip of pouches 125 (at block 1310). The electronic processor 1220 operates the universal feed cassette 115 of the automatic packager 105 to release medications to the packaging unit 120. The medications travel down the manifold 140 to be packaged into the strip of pouches 125. The universal feed cassette 115 is positioned generally above the packaging equipment such that medications slide down the manifold 140 toward the packaging equipment. The medications drop down the manifold 140 and are sealed into the strip of pouches 125. In some embodiments, the medications are sandwiched between two strips of material (e.g., aluminum, plastic, paper, etc.) from the feed stock rolls 230, 240. The two strips of material are then heat sealed together to form the strip of pouches 125 for the medications. In some embodiments, the packaging unit 120 may include a single feed stock roll having a single strip of material that is folded and/or heat sealed to form individual pouches 300.

The automatic packager 105 uses the verification system 250 to verify whether the strip of pouches 125 are correctly filled. For example, the camera system 430 captures one or more images of the filled pouches 300. The image(s) acquired by the camera system 430 are analyzed by the electronic processor 1220 or a remote computer for verification and returning a verification status.

The method 1300 includes dispensing, using the automatic packager 105, the strip of pouches 125 to the sorting device 110 (at block 1320). The strip of pouches 125 are dispensed from the automatic packager 105 once the strip of pouches 125 are packaged and verified. The sorting device 110 is configured to be interoperably coupled to the automatic packager 105. A technician may connect the strip of pouches 125 dispensed from the automatic packager 105 to the sorting device 110 by routing the strip of pouches 125 through the holder assembly 510 of the sorting device 110. The holder assembly 510 uses the pouch feed rollers 810 to advance the strip of pouches 125 through the sorting device 110. The electronic processor 1220 controls the pouch feed actuator 820 to advance the strip of pouches 125 using the pouch feed rollers 810.

The method 1300 further includes cutting and sorting, using the sorting device 110, the strip of pouches 125 (at block 1330). The strip of pouches 125 are directed through the sorting device 110 where the individual pouches 300 are cut and separated and directed into the first bin 540A or second bin 540B depending on the verification status of the individual pouch 300. The holder assembly 510 receives the strip of pouches 125 from the automatic packager 105 and holds the strip of pouches 125 for cutting and sorting. The strip of pouches 125 are fed from the holder assembly 510 to the cutter assembly 520 using the pouch feeder 630. The cutter assembly 520 uses a clamp assembly 910 to hold the strip of pouches 125 while a blade mechanism 550 cuts to separate the strip of pouches 125 into individual pouches 300. The electronic processor 1220 controls the blade actuator 1040 to cut the strip of pouches 125 with the reciprocating blade 1010. When cut, the individual pouches 300 drop from the cutter assembly 520 to the diverter 530. The diverter 530 pivots between the first bin 540A and the second bin 540B to direct the individual pouch 300 based on the verification status of the individual pouch 300 being directed. The electronic processor 1220 controls the diverter actuator 1120 to move the diverter 530 between the first position 1130 and the second position 1140 based on the verification status of the individual pouch 300 being directed.

In some embodiments, the sorting device 110 is operated at a faster speed than the automatic packager 105. This inhibits the strip of pouches 125 from forming a pool between the automatic packager 105 and the sorting device 110. However, this may result in the strip of pouches 125 between the automatic packager 105 and the sorting device 110 becoming taut and possibly breaking. The pouch tensioner 610 supports the strip of pouches 125 and pivots between various positions depending on the tension in the strip of pouches 125. When the strip of pouches 125 between the packaging unit 120 and the sorting device 110 is slack, the pouch tensioner 610 is in the first position 760 and directs the strip of pouches 125 to the sorting device 110. The electronic processor 1220 may determine a position of the pouch tensioner 610 using the tension sensor 670. The electronic processor 1220 temporarily disables the sorting device 110 (for example, disabling a function) in response to the strip of pouches 125 becoming taut. Disabling the sorting device 110 may include disabling the pouch feed actuator 820 (for example, a pouch feeding function), the blade actuator 1040 (for example, a cutting function), and/or the diverter actuator 1120 (for example, a sorting function). The electronic processor 1220 may continue to monitor the tension sensor 670 to restart the sorting device 110 once the tension is below a certain level or when the strip of pouches 125 between the automatic packager 105 and the sorting device 110 is slack.

Figure 14:
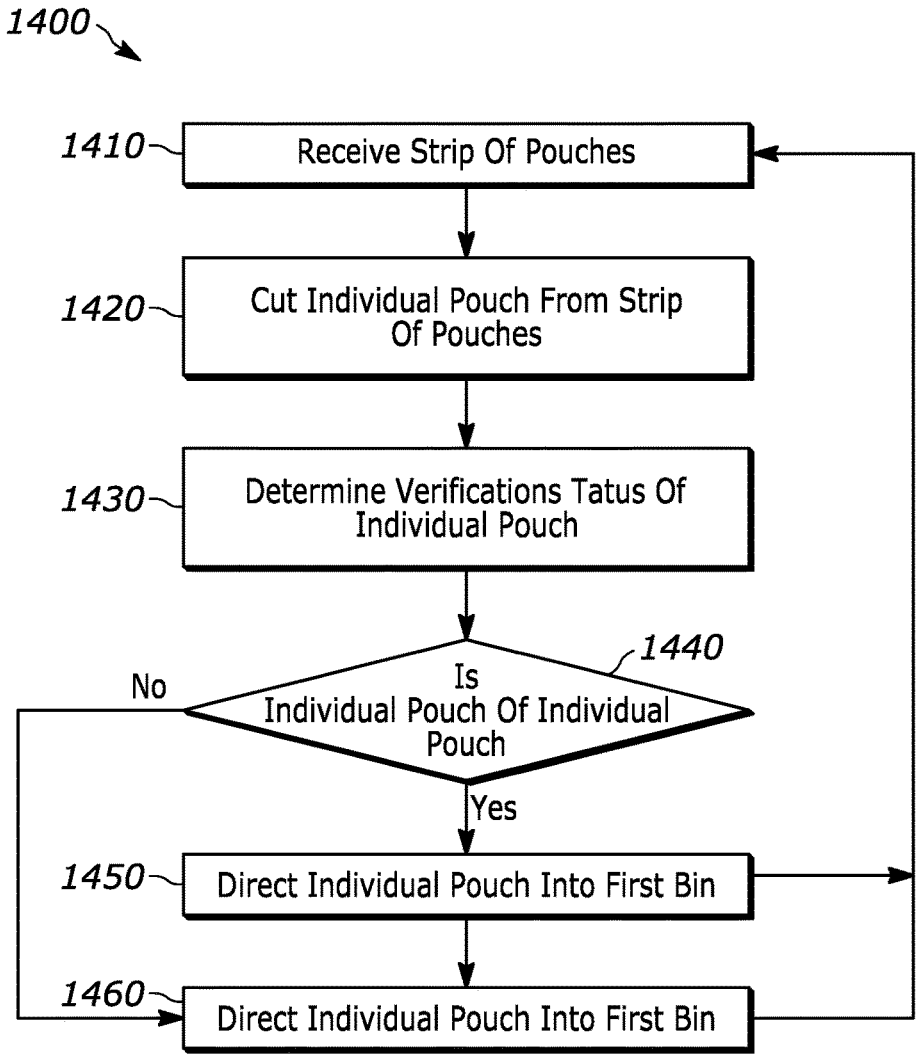
FIG. 14 is a flowchart depicting a method of sorting and cutting medications.

FIG. 14 is a flowchart illustrating one method 1400 for sorting medications. The method 1400 includes the receiving, from the packaging unit 120, the strip of pouches 125 (at block 1410). In particular, after the individual pouches 300 in the strip of pouches 125 receive their verification status, the automatic packager 105 dispenses the strip of pouches 125 to the sorting device 110. The sorting device 110 is configured to be interoperably coupled to the automatic packager 105. A technician may connect the strip of pouches 125 dispensed from the automatic packager 105 to the sorting device 110 by routing the strip of pouches 125 through the holder assembly 510 of the sorting device 110.

The holder assembly 510 receives and advances the strip of pouches 125 through the sorting device 110 The technician routes the strip of pouches 125 through the pouch receiving portion 650, the holding portion 640, the pouch guide 620, and the pouch feeder 630. The strip of pouches 125 is received between the pouch feed rollers 810 of the pouch feeder 630. The pouch feed rollers 810 are used to advance the strip of pouches through the holder assembly 510 and the sorting device 110. The electronic processor 1220 controls the pouch feed actuator 820 to operate the pouch feed rollers 810.

The method 1400 includes cutting, using the cutter assembly 520, the strip of pouches 125 (at block 1420). The pouch feeder 630 feeds the strip of pouches 125 to the clamp assembly 910. The electronic processor 1220 controls the clamp actuator 920 to activate the clamp slider 950. The clamp slider 950 is activated to clamp the strip of pouches 125 between the clamp 930 and the clamp frame 940. The electronic processor 1220 controls the blade actuator 1040 to activate the blade mechanism 550. The blade mechanism 550 reciprocates the blade 1010 to cut an individual pouch 300 (or group of pouches 300) from the strip of pouches 125. Such an arrangement allows for the individual pouches 300 (or group of pouches 300) to be easily separated from the strip of pouches 125. Other embodiments may involve varying cutting techniques. Once the individual pouch 300 (or group of pouches 300) is separated from the strip of pouches 125, the electronic processor 1220 releases the clamp 930 and advances the strip of pouches 125 to cut the next individual pouch 300 (or group of pouches 300) from the strip of pouches 125.

The method 1400 further includes determining, using the electronic processor 1220, a verification status of the individual pouch 300 (at block 1430). The verification status of each individual pouch 300 may be determined using the verification system 450. The electronic processor 1220 tracks the position of the individual pouches 300 through the verification system 450 and the sorting device 110. For example, each individual pouch 300 includes an indicia (or barcode) 320, which can be used to identify the individual pouch 300. The verification status of each individual pouch 300 output from the verification system 450 can be stored in relation with the identification information of the individual pouch 300 in the memory 1230. Additionally, identification information of each subsequent individual pouch 300 is stored in memory 1230 in relation to its position on the strip of pouches 125. In one example, the electronic processor 1220 stores the identification information of the individual pouches 300 in sequence in a list according to the individual pouches 300 relative position in the strip of pouches 125. When the barcode 320 of the individual pouch 300 is later scanned, the electronic processor 1220 retrieves the verification status for the individual pouch 300 from the memory based on the identification information of the individual pouch 300.

During operation, the electronic processor 1220 keeps track of the position of the individual pouch 300 such that the electronic processor 1220 is aware of or can determine which individual pouch 300 is currently being separated from the strip of pouches 125 by the cutter assembly 520, for example, using the sequence list stored in the memory 1230. In some embodiments, the pouch sensor 1115 may be used as a check to determine the current position of the strip of pouches 125. The electronic processor 1220 controls the pouch sensor 1115 (for example, a barcode, QR code scanner, a camera, or the like) to capture the image of the individual pouch 300 being separated from the strip of pouches 125. The electronic processor 1220 identifies the individual pouch 300 based on the identification information scanned by the pouch sensor 1115 and determines the current position of the strip of pouches 125. The electronic processor 1220 determines the verification status of the individual pouch 300 that is currently being separated based on the known position of the strip of pouches 125. In some embodiments, the pouch sensor 1115 can be used to identify each individual pouch 300 being separated rather than to simply detect the position of the strip of pouches 125.

The method 1400 also includes determining, using the electronic processor 1220, whether the individual pouch 300 is correctly filled based on the verification status of the individual pouch 300 (at block 1440). As discussed above, the electronic processor 1220 determines the verification status of each individual pouch 300. The electronic processor 1220 determines whether the individual pouch 300 is correctly or incorrectly filled based on the verification status of the individual pouch 300.

The method 1400 includes directing, using the diverter 530, the individual pouch 300 to the first bin 540A when the individual pouch 300 is correctly filled (at block 1450). The electronic processor 1220 controls the diverter actuator 1120 to move the diverter 530 to the first position 1130. The diverter 530 rotates to the first diverter position 1130 and directs the individual pouch 300 to the first bin 540A. The method includes directing, using the diverter 530, the individual pouch 300 to the second bin 540B when the individual pouch 300 is incorrectly filled (at block 1460). The electronic processor 1220 controls the diverter actuator 1120 to move the diverter 530 to the second position 1140. The diverter 530 rotates to the second diverter position 1140 and directs the individual pouch 300 to the second bin 540B. Through the use of gravity, the positioning of the diverter 530 directs the individual pouch 300 to fall into the first bin 540A or the second bin 540B.

Figure 15:
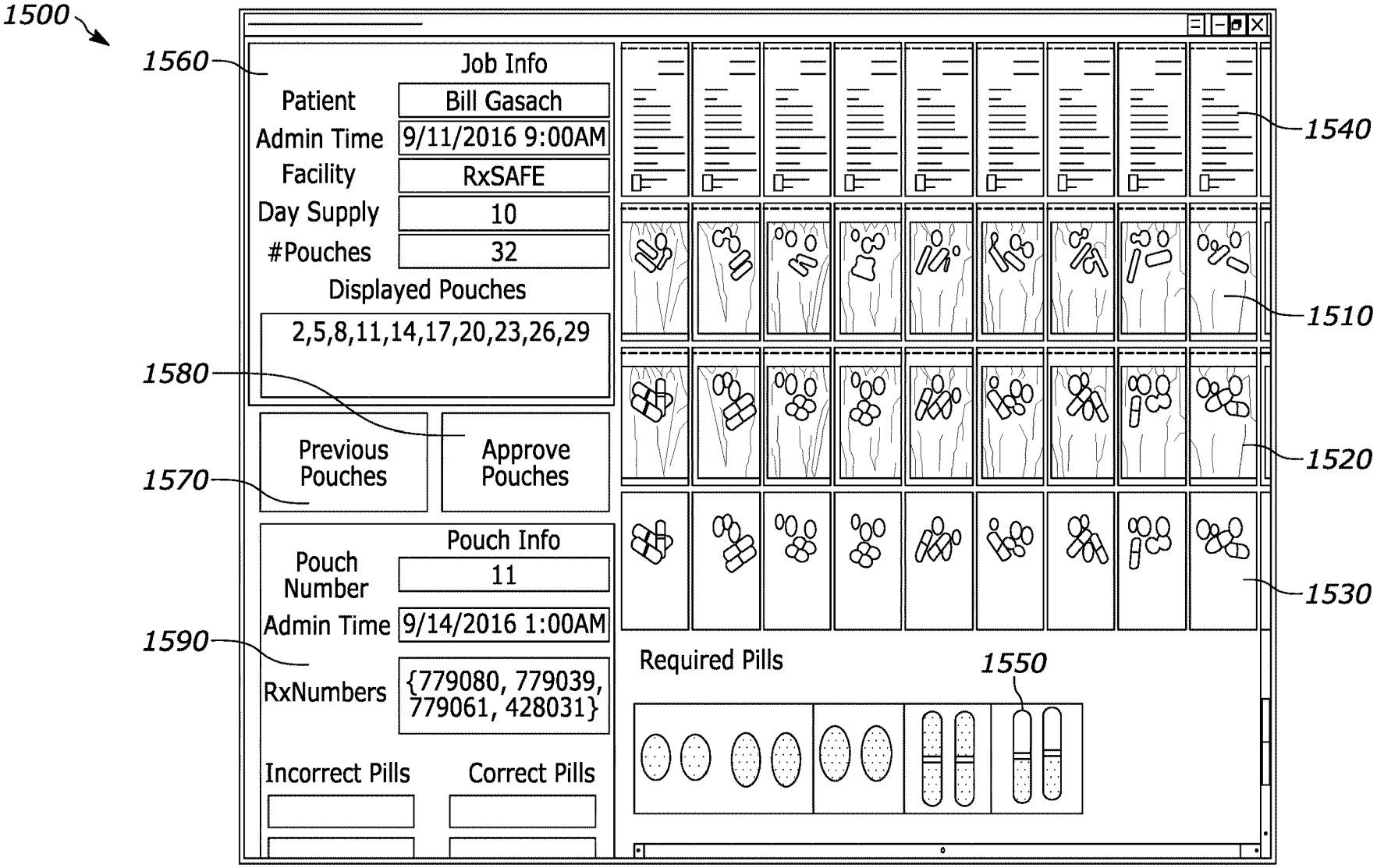
FIG. 15 illustrates a dashboard generated to verify the medications in a pouch.

FIG. 15 illustrates a dashboard 1500 that may be generated by the processor 1220 to aid a pharmacist in verifying that the individual pouches 300 are correctly filled and producing the verification status. The dashboard 1500 is a compilation of images captured by the verification system 250 and generated by the processor 1220. The dashboard 1500 may simultaneously display images from multiple individual pouches 300 or may only display images from one pouch at a time. In some embodiments, the dashboard 1500 may be displayed on a user interface (e.g., the input/output interface) of the automatic packager system 100. In other embodiments, the dashboard 1500 may be sent to a computing device (e.g., a smart telephone or a tablet computer) of a remote pharmacist.

In the example illustrated, the dashboard 1500 includes an infrared image 1510, a visible light second image 1520, a third image 1530 based on the first and second images 1510, 1520, label information 1540 (e.g., information returned by the processor 1220 when the indicia 320 is scanned), and images of expected pills 1550. The illustrated dashboard 1500 also includes an interface for navigating the dashboard 1500, including patient information 1560, a "Previous Pouches" button 1570, an "Approve Pouches" button 1580, and individual pouch information 1590. As shown, the first image 1510, the second image 1520, the third image 1530, and the label information 1540 may be arrayed in a grid on the dashboard 1500, with each column of the grid corresponding to the images associated with one of the individual pouches 300. The first image 1510 is the infrared image captured by the camera system 430. The second image 1520 is the visible light image captured by the camera system 430. The third image is generated by the processor 1220, as explained above. In the present embodiment, the label information 1540 is a computer-generated list of data associated with the barcode 255 of the individual pouch 300. The images of expected pills 1550 are stock images of the medication that a pharmacist should be expecting to see in the individual pouch 300 based on the information input to pack the individual pouch 300. The patient information 1560 provides information about a patient to whom the pouch is being dispensed. The patient information 1560 may include, for example, patient name, administration time, facility, and the like. The "Previous Pouches" button 1570 allows a user (for example, a pharmacist) to navigate to screens or columns of previous pouches stored in the system. The "Approve Pouches" button 1580 allows the user to approve the current pouches displayed on the dashboard 1500 and dispense the individual pouches 300 to the patient. Once the displayed pouches are approved by actuating the button 1580, the dashboard 1500 can automatically navigate to the next screen or columns of pouches. The pouch information 1590 displays information about the individual pouches 300 being shown on the dashboard 1500. The pouch information 1590 may include, for example, a pouch number, an administration time, a prescription number, and the like.

In some embodiments, the processor 1220 may also automatically determine whether the individual pouches 300 are correctly filled or incorrectly filled. This automatic verification can be used to assist a pharmacist in making his or her determination on whether the individual pouches 300 were properly filled. In one example technique, the processor 1220 determines whether the number of medications or the type of medications (e.g., a first characteristic of medications) included in the individual pouch 300 matches the number of medications or the type of medications (e.g., a second characteristic of expected pharmaceuticals) of expected medications, based on the label information 1540 or information that is in the prescription order input. The processor 1220 may analyze the first image 1510, the second image 1520, the third image 1530, or a combination of the three images to determine the number of medications included in the individual pouch 300. For example, the processor 1220 may determine the number of medications included in the individual pouch 300 based on the distinct shadows created in the first image 1510. In other embodiments, other known techniques may be used to determine the number of medications included in the pouch based on analyzing an image of the pouch.

The processor 1220 may also analyze the third image 1530 of the pouch to determine the type of medications included in the pouch. The processor 1220 may employ known color analysis techniques on the third image 1530 in addition to the known information from the expected pills 1550 to determine whether the correct type of medications are included in the pouch. Additionally or alternatively, the processor 1220 may use images captured by cameras on the universal feed cassette 115 to help identify the medications and to verify that the correct medications were dropped.

Based on these comparisons, the processor 1220 provides the verification status on the dashboard 1500 to identify whether the processor 1220 thinks the individual pouches 300 were correctly or incorrectly filled. The processor 1220 then references this indication when controlling the sorting device 110, allowing the diverter 530 to place the individual pouches 300 in the first bin 540A or the second bin 540B, based on the verification status.

It should be understood that various aspects disclosed herein may be combined in different combinations than the combinations specifically presented in the description and accompanying drawings. It should also be understood that, depending on the example, certain acts or events of any of the processes or methods described herein may be performed in a different sequence, may be added, merged, or left out altogether (e.g., all described acts or events may not be necessary to carry out the techniques). In addition, while certain aspects of this disclosure are described as being performed by a single module or unit for purposes of clarity, it should be understood that the techniques of this disclosure may be performed by a combination of units or modules associated with, for example, a medication packaging system.

Various features and advantages of the invention are set forth in the following claims.

What is claimed is:

1. An automatic packager system comprising:

an automatic packager including:

a packager housing, a dispenser on the packager housing configured to dispense medications into a strip of pouches; and a sorting device interoperably coupled to the automatic packager, the sorting device configured to receive the strip of pouches from the automatic packager and including:

a holder assembly configured to hold the strip of pouches received from the automatic packager, a cutter assembly provided downstream of the holder assembly to receive the strip of pouches from the holder assembly, the cutter assembly includes a blade and is configured to cut and separate an individual pouch from the strip of pouches using reciprocal motion of the blade, and a diverter provided downstream of the cutter assembly to receive the individual pouch from the cutter assembly and configured to dispense the individual pouch into a first bin or a second bin based on a verification status of the individual pouch, wherein the sorting device operates at a faster speed than the automatic packager.

2. The automatic packager system of claim 1, further comprising a first feed stock roll and a second feed stock roll configured to form the strip of pouches.

3. The automatic packager system of claim 2, further comprising a printer configured to print a barcode on the second feed stock roll.

4. The automatic packager system of claim 2, wherein the second feed stock roll is provided on the exterior of the packager housing.

5. The automatic packager system of claim 1, further comprising a verification system configured to:

capture images of the individual pouch;

verify whether the individual pouch is correctly filled based on the images; and output the verification status for the individual pouch.

6. The automatic packager system of claim 1, wherein the holder assembly includes a tension sensor configured to sense tension in the strip of pouches.

7. The automatic packager system of claim 6, wherein a function of the sorting device is configured to be temporarily disabled when the tension sensor detects the tension in the strip of pouches.

* * * * *